US008897909B2

(12) United States Patent
Yamada

(10) Patent No.: US 8,897,909 B2
(45) Date of Patent: Nov. 25, 2014

(54) EMBROIDERY DATA GENERATION APPARATUS AND COMPUTER PROGRAM PRODUCT

(75) Inventor: Kenji Yamada, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 429 days.

(21) Appl. No.: 13/460,160

(22) Filed: Apr. 30, 2012

(65) Prior Publication Data

US 2012/0303152 A1 Nov. 29, 2012

(30) Foreign Application Priority Data

May 24, 2011 (JP) ..... 2011-115301

(51) Int. Cl.
*D05C 5/02* (2006.01)

(52) U.S. Cl.
USPC ..... 700/138; 112/470.01

(58) Field of Classification Search
USPC ..... 700/136–138; 112/102.5, 470.01, 112/470.04, 475.18, 475.19
See application file for complete search history.

(56) References Cited

U.S. PATENT DOCUMENTS 5,794,553 A * 8/1998 Futamura ..... 112/102.5
6,012,402 A * 1/2000 Sekine ..... 112/102.5
6,629,015 B2 * 9/2003 Yamada ..... 700/138
6,980,877 B1 * 12/2005 Hagino et al. ..... 700/138
7,908,985 B2 * 3/2011 Okuyama ..... 112/102.5
7,930,057 B2 * 4/2011 Hayakawa et al. ..... 700/138
7,949,421 B2 * 5/2011 Hayakawa et al. ..... 700/138
7,991,500 B2 * 8/2011 Roos ..... 700/138
2010/0305744 A1 12/2010 Yamada
2011/0160894 A1 * 6/2011 Yamada ..... 700/138

FOREIGN PATENT DOCUMENTS

JP A-2001-259268 9/2001
JP A-2010-273859 12/2010

* cited by examiner

*Primary Examiner* — Nathan Durham
(74) *Attorney, Agent, or Firm* — Oliff PLC

(57) ABSTRACT

An embroidery data generation apparatus that generates embroidery data based on image data of an image that is an aggregate of pixels includes a thread color number setting portion that sets a number of use thread colors as a set number, a representable color identifying portion that identifies available thread colors and at least one intermediate color as representable colors, a first usage frequency calculating portion that calculates first usage frequencies of the representable colors, each of the first usage frequencies being a usage frequency of each of the representable colors in the image that is color-reduced using, as representative colors, the representable colors, and a use thread color determining portion that, based on the first usage frequencies, determines, as the use thread colors, available thread colors of the set number, from among the available thread colors.

14 Claims, 12 Drawing Sheets

FIG. 5

| REPRESENTABLE COLOR | CORRESPONDING AVAILABLE THREAD COLOR | USAGE FREQUENCY (NUMBER OF PIXELS) |
|---|---|---|
| c[11] | c1, c1 | 10 |
| c[12] | c1, c2 | 5 |
| c[13] | c1, c3 | 6 |
| c[14] | c1, c4 | 1 |
| c[22] | c2, c2 | 7 |
| c[23] | c2, c3 | 10 |
| c[24] | c2, c4 | 4 |
| c[33] | c3, c3 | 15 |
| c[34] | c3, c4 | 8 |
| c[44] | c4, c4 | 3 |

FIG. 6

| COMBINATION | REPRESENTABLE COLOR THAT CAN BE REPRESENTED BY COMBINATION | USAGE FREQUENCY TOTAL VALUE |
|---|---|---|
| c1, c2 | c[11], c[12], c[22] | 22 |
| c1, c3 | c[11], c[13], c[33] | 31 |
| c1, c4 | c[11], c[14], c[44] | 14 |
| c2, c3 | c[22], c[23], c[33] | 32 |
| c2, c4 | c[22], c[24], c[44] | 14 |
| c3, c4 | c[33], c[34], c[44] | 26 |

FIG. 9

| AVAILABLE THREAD COLOR | USAGE FREQUENCY (NUMBER OF PIXELS) |
|---|---|
| c1 | 32 |
| c2 | 33 |
| c3 | 54 |
| c4 | 19 |

EMBROIDERY DATA GENERATION APPARATUS AND COMPUTER PROGRAM PRODUCT

CROSS-REFERENCE TO RELATED APPLICATION

This application claims priority to Japanese Patent Application No. 2011-115301, filed May 24, 2011, the content of which is hereby incorporated herein by reference.

BACKGROUND

The present disclosure relates to an embroidery data generation apparatus and a computer program product that generate embroidery data to perform embroidery sewing using a sewing machine that is capable of embroidery sewing.

An embroidery data generation apparatus is known that generates embroidery data for sewing, in embroidered form, a design based on image data such as a photograph or the like, using a sewing machine that is capable of embroidery sewing. For example, according to a known embroidery data generation apparatus, based on image data acquired from an image that is read using an image scanner, angle characteristics and angle characteristic intensities may be calculated for various portions in the image. Line segments may be arranged in accordance with the calculated angle characteristics and angle characteristic intensities. Then, a thread color corresponding to each line segment may be determined, and line segments of the same thread color may be connected. After that, line segment data may be converted to data that indicates stitches, and embroidery data thus may be generated. A number n of thread colors to be used may be determined in advance as the thread colors that are actually used when an embroidery pattern is sewn. The thread color corresponding to each line segment may be selected from among the number n of the thread colors to be used.

SUMMARY

When an image, such as a photograph, is represented as an embroidered design, there may be limitations on embroidery threads and needle thicknesses. As a result, detailed representation may not be possible, as is possible with pixels. There may be a limit to the number of thread colors that a user can prepare (available thread colors), and normally, approximately 100 colors may be conceivable. Taking into account a number of times of thread changes, the number of thread colors that is actually used may be further limited, and may be realistically approximately 10 colors. It is therefore important to select, from the approximately 100 colors, approximately 10 thread colors that are most appropriate to represent the original image. In the above-described known embroidery data generation apparatus, the colors of the original image may be reduced to the number n of colors. After that, the number n of the thread colors to be used may be determined by selecting, from among the available thread colors, a color that is closest to each of the number n of colors after the color reduction. In this method, the available thread colors are sufficiently uniformly distributed in a color space, and, if one of the thread colors is sufficiently close to each of the number n of colors after color reduction of the original image, it is possible to determine the number n of appropriate thread colors to be used. However, the available thread colors may not be necessarily always in such a condition.

Embodiments of the broad principles derived herein provide an embroidery data generation apparatus and a computer program product that are capable of generating embroidery data by selecting thread colors suitable to represent an original image, from among available thread colors that can be prepared by a user.

Embodiments provide an embroidery data generation apparatus that generates embroidery data based on image data of an image that is an aggregate of pixels. The embroidery data generation apparatus includes a thread color number setting portion, a representable color identifying portion, a first usage frequency calculating portion, and a use thread color determining portion. The thread color number setting portion sets a number of use thread colors as a set number. The use thread colors are thread colors to be actually used in embroidery sewing by a sewing machine. The representable color identifying portion identifies available thread colors and at least one intermediate color as representable colors. The available thread colors are thread colors available for use in the embroidery sewing by the sewing machine. Each of the at least one intermediate color is an intermediate color between two colors among the available thread colors. The first usage frequency calculating portion calculates first usage frequencies of the representable colors. Each of the first usage frequencies is a usage frequency of each of the representable colors in the image that is color-reduced using, as representative colors, the representable colors identified by the representable color identifying portion. The use thread color determining portion determines, based on the first usage frequencies calculated by the first usage frequency calculating portion, as the use thread colors, available thread colors of the set number set by the thread color number setting portion, from among the available thread colors.

Embodiments also provide a computer program product stored on a non-transitory computer-readable medium. The computer program product includes instructions for causing a computer of an embroidery data generation apparatus that generates embroidery data based on image data of an image that is an aggregate of pixels, to execute the step of setting a number of use thread colors as a set number. The use thread colors are thread colors to be actually used in embroidery sewing by a sewing machine. The computer program product also includes instructions for causing the computer of the embroidery data generation apparatus to execute the step of identifying available thread colors and at least one intermediate color as representable colors. The available thread colors are thread colors available for use in the embroidery sewing by the sewing machine. Each of the at least one intermediate color is an intermediate color between two colors among the available thread colors. The computer program product further includes instructions for causing the computer of the embroidery data generation apparatus to execute the step of calculating first usage frequencies of the representable colors. Each of the first usage frequencies is a usage frequency of each of the representable colors in the image that is color-reduced using, as representative colors, the representable colors that have been identified. The computer program product further includes instructions for causing the computer of the embroidery data generation apparatus to execute the step of determining, based on the first usage frequencies that have been calculated, as the use thread colors, available thread colors of the set number that has been set, from among the available thread colors.

BRIEF DESCRIPTION OF THE DRAWINGS

Embodiments will be described below in detail with reference to the accompanying drawings in which:

FIG. 5 is an explanatory diagram showing an example of a representable color list;

FIG. 6 is an explanatory diagram of an example of calculating total values of usage frequencies corresponding to combinations;

FIG. 9 is an explanatory diagram of an example of calculating total values of usage frequencies corresponding to available thread colors;

DETAILED DESCRIPTION

Embodiments of the present disclosure will be explained with reference to the appended drawings.

First Embodiment

A first embodiment will be explained with reference to FIG. 1 to FIG. 6. First, a configuration of an embroidery data generation apparatus 1 will be explained with reference to FIG. 1. The embroidery data generation apparatus 1 is an apparatus that generates embroidery data that is used to sew an embroidery pattern using a sewing machine 3 (refer to FIG. 2) that will be explained below. The embroidery data generation apparatus 1 of the present embodiment can generate embroidery data to perform embroidery sewing of a design based on an image such as a photograph or the like.

Figure 1:
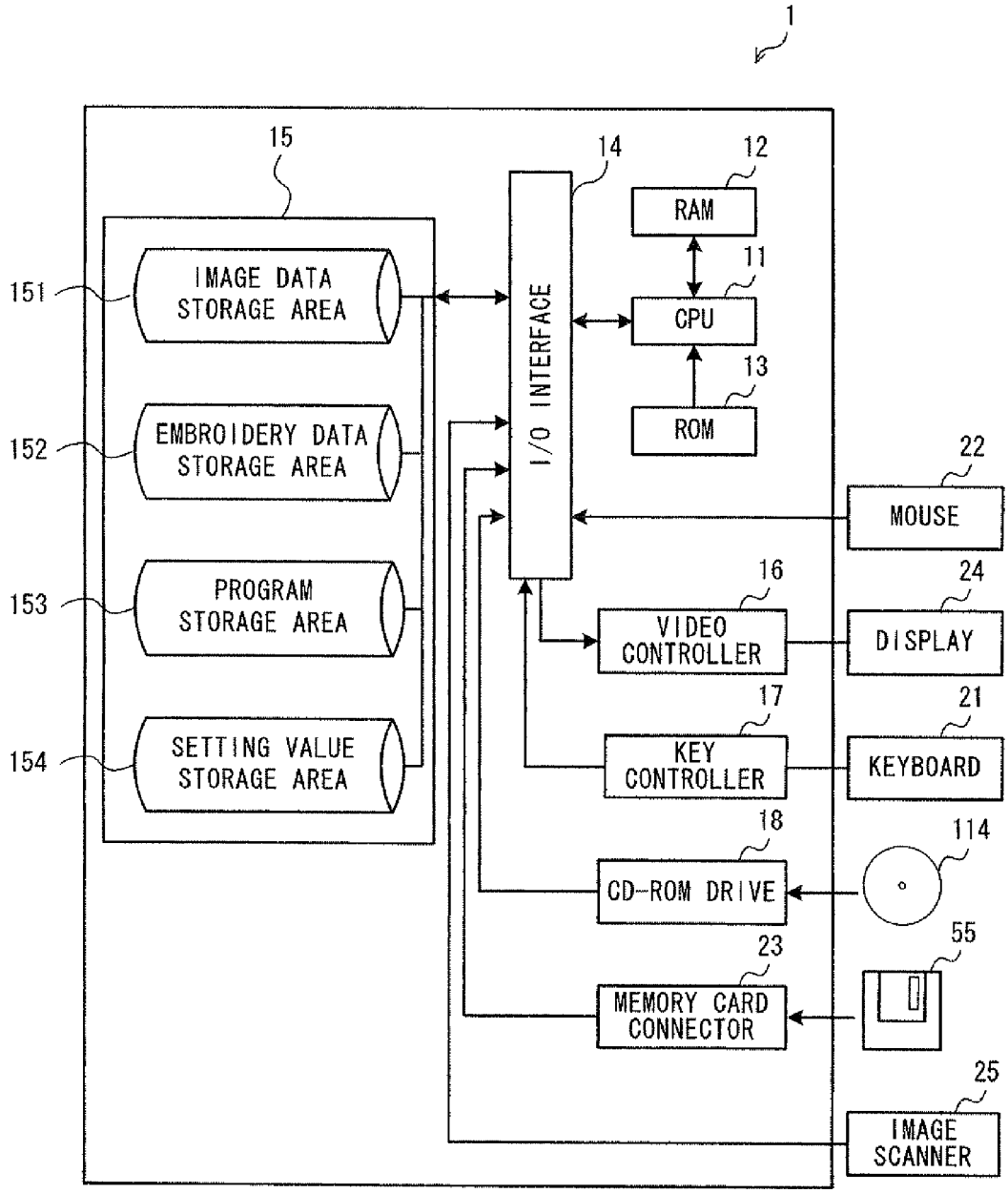
FIG. 1 is a block diagram showing an electrical configuration of an embroidery data generation apparatus.

The embroidery data generation apparatus 1 may be, for example, a general-purpose apparatus, such as a personal computer or the like. As shown in FIG. 1, the embroidery data generation apparatus 1 includes a CPU 11, which is a controller that controls the embroidery data generation apparatus 1. A RAM 12, a ROM 13, and an input/output (I/O) interface 14 are connected to the CPU 11. The RAM 12 may temporarily store various types of data. The ROM 13 may store BIOS etc. The I/O interface 14 may perform relay of transmission and reception of data. A hard disk device (HDD) 15, a mouse 22, which is an input device, a video controller 16, a key controller 17, a CD-ROM drive 18, a memory card connector 23, and an image scanner 25 may be connected to the I/O interface 14. Further, although not shown in FIG. 1, the embroidery data generation apparatus 1 may include an external interface to connect with an external device and a network.

A display 24, which is a display device, may be connected to the video controller 16. A keyboard 21, which is an input device, may be connected to the key controller 17. A CD-ROM 114 may be inserted into the CD-ROM drive 18. For example, when an embroidery data generation program is set up, the CD-ROM 114 that stores the embroidery data generation program may be inserted into the CD-ROM drive 18. Then, the embroidery data generation program may be read and stored in a program storage area 153 of the HDD 15. A memory card 55 may be connected to the memory card connector 23. It is then possible to read information from the memory card 55 and write information onto the memory card 55. The image that is used to generate the embroidery data of the present embodiment may be read into the embroidery data generation apparatus 1 via the image scanner 25, for example.

Storage areas of the HDD 15 will be explained. As shown in FIG. 1, the HDD 15 has a plurality of storage areas, including an image data storage area 151, an embroidery data storage area 152, the program storage area 153, and a setting value storage area 154. Image data of various images, such as the image that is used to generate the embroidery data, may be stored in the image data storage area 151. The embroidery data that are generated by embroidery data generation processing of the present embodiment may be stored in the embroidery data storage area 152. Programs for various kinds of processing executed by the embroidery data generation apparatus 1, such as the embroidery data generation program that will be explained below, may be stored in the program storage area 153. Various setting values that are used in the various kinds of processing may be stored in the setting value storage area 154.

Figure 2:
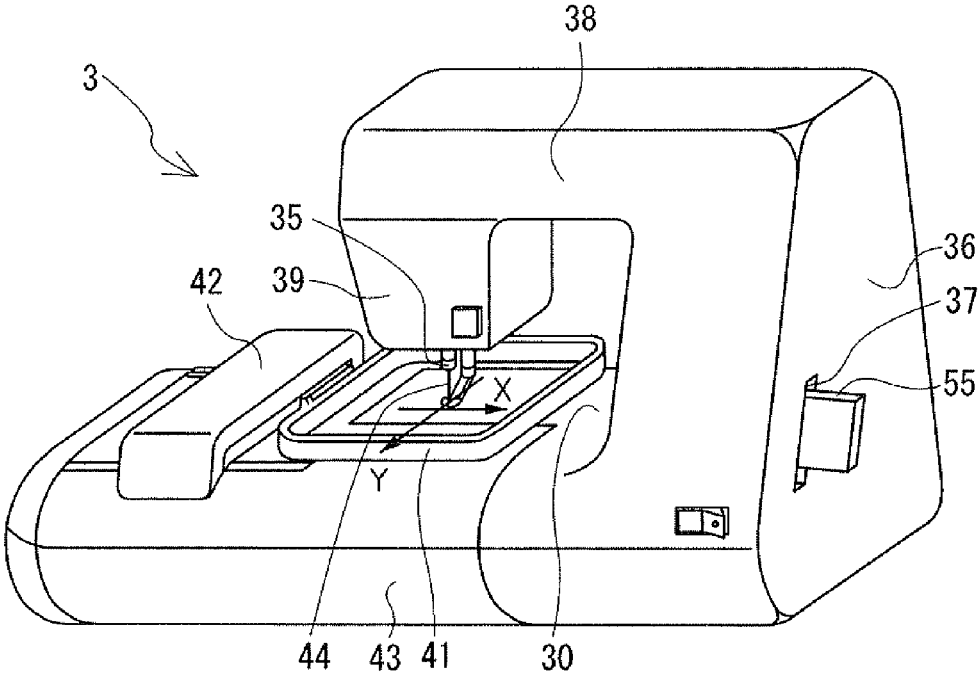
FIG. 2 is an external view of a sewing machine.

The sewing machine 3, which can sew an embroidery pattern based on the embroidery data generated by the embroidery data generation apparatus 1, will be briefly explained with reference to FIG. 2. As shown in FIG. 2, the sewing machine 3 includes a bed 30, a pillar 36, an arm 38, and a head 39. The bed 30 is a base portion of the sewing machine 3, and the bed 30 is longer in the left-right direction with respect to a user of the sewing machine 3. The pillar 36 extends in the upward direction from a right end portion of the bed 30. The arm 38 extends in the leftward direction from the upper end of the pillar 36 such that the arm 38 faces the bed 30. The head 39 is a portion that connects to the left end of the arm 38. An embroidery frame 41, which can hold a work cloth on which embroidery is sewn, can be placed above the bed 30.

When embroidery sewing is performed, the embroidery frame 41 is moved to a needle drop point indicated by an X-Y coordinate system that is unique to the sewing machine 3, by a Y-direction drive portion 42 and an X-direction drive mechanism (not shown in the drawings). The Y-direction drive portion 42 is placed on the bed 30. The X-direction drive mechanism is housed in a body case 43. A needle bar 35 to which a needle 44 is attached, and a shuttle mechanism (not shown in the drawings) may be driven in accordance with the embroidery frame 41 being moved, and thus an embroidery pattern may be formed on the work cloth. The Y-direction drive portion 42, the X-direction drive mechanism, the needle bar 35 and, the like may be controlled, based on the embroidery data, by a control apparatus (not shown in the drawings) that includes a microcomputer incorporated in the sewing machine 3.

A memory card slot 37 is provided on a side surface of the pillar 36 of the sewing machine 3, and the memory card 55 may be inserted into and removed from the memory card slot 37. For example, the embroidery data generated by the embroidery data generation apparatus 1 may be stored in the memory card 55 via the memory card connector 23. After that, the memory card 55 may be inserted into the memory card slot 37 of the sewing machine 3, and the stored embroidery data may be read out and stored in the sewing machine 3.

Based on the embroidery data read out from the memory card 55, the control apparatus (not shown in the drawings) of the sewing machine 3 may control sewing operations of the embroidery pattern performed by the above-described elements. In this manner, the embroidery pattern may be sewn using the sewing machine 3, based on the embroidery data generated by the embroidery data generation apparatus 1.

Figure 3:
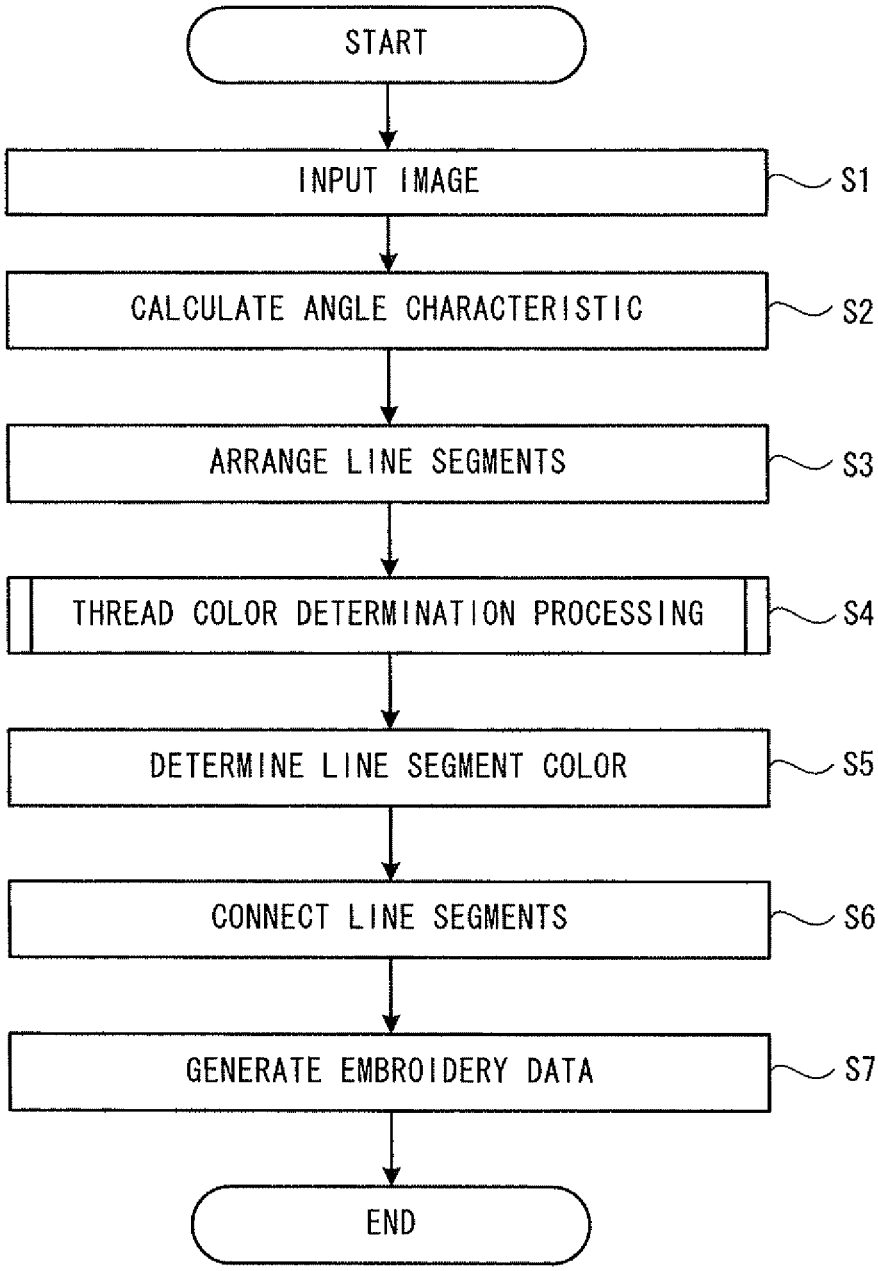
FIG. 3 is a flowchart of main processing that is performed by the embroidery data generation apparatus.

Hereinafter, main processing that is performed by the embroidery data generation apparatus 1 of the first embodiment will be explained with reference to FIG. 3 to FIG. 6. When a command is input to start the main processing, the embroidery data generation program stored in the program storage area 153 of the HDD 15 is activated and the main processing shown in FIG. 3 is started. The main processing is performed by the CPU 11 executing the embroidery data generation program.

As shown in FIG. 3, first, image data of an image that is used to generate embroidery data is input into the embroidery data generation apparatus 1 (step S1). The image that is used to generate embroidery data is hereinafter referred to as an original image. A method for inputting the image data is not particularly limited. A photograph or a design may be read by the image scanner 25, for example, and the obtained image data may be used. Alternatively, image data that are stored in advance in the image data storage area 151 of the HDD 15, or image data that are stored on an external recording medium, such as the CD-ROM 114, the memory card 55, a CD-R or the like, may be input.

An angle characteristic and an intensity of the angle characteristic are calculated for each of a plurality of pixels that form the original image (step S2). The angle characteristic is information that indicates a direction of high connectability of a color in the image. The intensity of the angle characteristic is information indicating the magnitude of color change.

The angle characteristic and the intensity may be calculated using any method. For example, Japanese Laid-Open Patent Publication No. 2001-259268 discloses a method of calculating an angle characteristic and an intensity of the angle characteristic, the relevant portions of which are incorporated by reference. A detailed explanation is thus omitted here and only an outline explanation is made. First, from among the plurality of pixels forming the original image, one pixel is designated as a target pixel. The target pixel and a predetermined number of pixels surrounding the target pixel are designated as a target area. Based on an attribute value (a luminance value, for example) relating to a color of each of the pixels in the target area, the direction of high connectability of a color in the target area is identified, and the identified direction is set as the angle characteristic of the target pixel. Further, a value indicating the magnitude of color change in the target area is calculated, and the calculated value is set as the intensity of the angle characteristic of the target pixel. Processing that calculates the angle characteristic and its intensity in this way is sequentially performed for all the pixels forming the original image. Data indicating the angle characteristic and its intensity for each of the pixels are stored in a specific storage area of the RAM 12. A plurality of the pixels may be designated as the target pixels and the similar processing may be performed. Further, the angle characteristic and its intensity may be calculated using a method other than that described above, such as the Prewitt operator, the Sobel operator, or the like.

Based on the angle characteristic and the intensity of the angle characteristic that have been calculated, processing is performed to arrange the line segments, and data identifying the line segments are stored in the RAM 12 (step S3). The data identifying the line segments is hereinafter referred to as line segment data. The arrangement of the line segments based on the angle characteristics and the intensity of the angle characteristics may be performed using any method. For example, Japanese Laid-Open Patent Publication No. 2001-259268 discloses a method of arranging line segments based on angle characteristics and intensity of the angle characteristics, the relevant portions of which are incorporated by reference. A detailed explanation is thus omitted here, and only an outline explanation is made. First, taking each of the pixels that form the original image as a center of the line segment, the line segment that has a pre-set length is arranged extending in a direction that is indicated by the angle characteristic calculated at step S2. Data identifying the arranged line segment are generated. In order for characteristics of the whole image to be effectively incorporated, from among the plurality of pixels forming the original image, the line segments are arranged corresponding to only the pixels whose intensity of angle characteristic calculated at step S2 is larger than a predetermined threshold value. On the other hand, with respect to the pixels whose intensity of angle characteristic is equal to or lower than the threshold value, the line segments are arranged based on new angle characteristics that are calculated by taking the angle characteristics of the surrounding pixels into account. The line segments are finally converted into stitches, and represent the original image. Thus, as disclosed in Japanese Laid-Open Patent Publication No. 2001-259268, the line segments are arranged such that the line segments cover the whole of the original image as much as possible, and with as little overlap as possible.

Next, thread color determination processing (refer to step S4, FIG. 4) is performed. The thread color determination processing is processing to determine a plurality of thread colors that are actually used, from among a plurality of thread colors that can be prepared by the user for embroidery sewing using the sewing machine 3, namely, from among the plurality of thread colors that are available for use on the sewing machine 3. The thread color determination processing will be explained in detail with reference to FIG. 4. In the following explanation, the thread colors that are available for use on the sewing machine 3 are referred to as available thread colors. The thread colors that are actually used in embroidery sewing using the sewing machine 3 are referred to as use thread colors.

Figure 4:
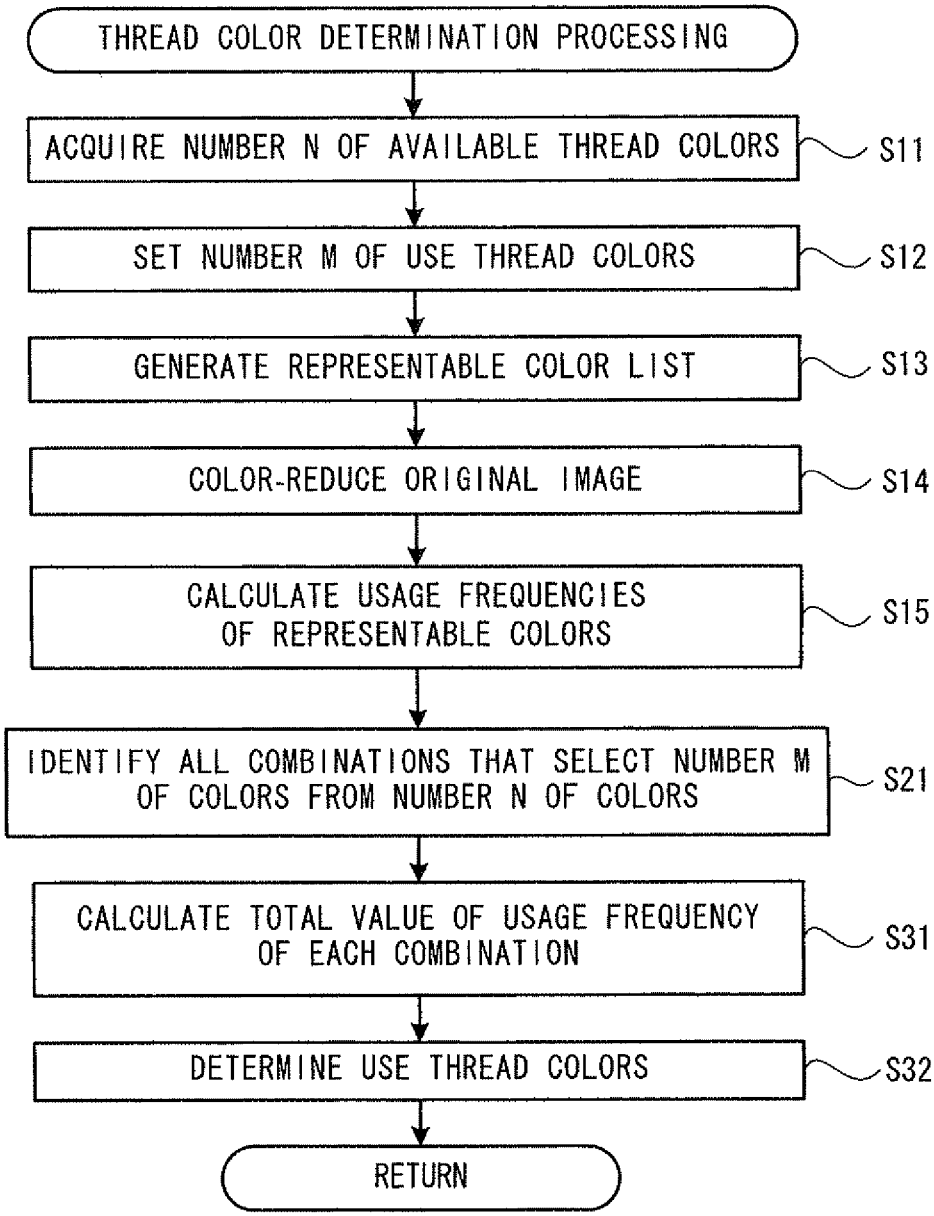
FIG. 4 is a flowchart of thread color determination processing according to a first embodiment that is performed in the main processing.

As shown in FIG. 4, in the thread color determination processing, first, information is acquired to identify a number N of the available thread colors and the information is stored in the RAM 12 (step S11). In the present embodiment, the information to identify the available thread colors includes at least RGB values. The information to identify the available thread colors may include thread numbers etc. in addition to the RGB values. Information that is stored in advance in the setting value storage area 154 of the HDD 15 may be acquired as the information to identify the available thread colors. Information that is input by the user may be acquired as the information to identify the available thread colors. From among the number N of the available thread colors, a number M of the thread colors that are actually used is set (step S12). The number M of the use thread colors is an integer that is smaller than a total number N of the available thread colors. The number M of the use thread colors may be, for example, set to the value that is set in advance while taking into account a number of times to change threads and is stored in the setting value storage area 154 of the HDD 15. The number M of the use thread colors may be set to the value input by the user. The number M of the use thread colors that is set is stored in the RAM 12. The number M of the use thread colors that is set is hereinafter referred to as a set number M.

Based on the RGB values of the number N of the available thread colors acquired at step S11, from among the number N of the available thread colors, a plurality of colors (hereinafter referred to as representable colors) are identified that can be represented by one color or two colors. The RGB values of each of the representable colors are calculated. Then, a list (hereinafter referred to as a representable color list) is generated in which the identified plurality of representable colors and the available thread colors that are necessary to represent the representable colors are associated with a usage frequency that will be explained below. The generated representable color list is stored in the RAM 12 (step S13).

In the present embodiment, in order to represent as many colors as possible using a limited number of the thread colors, the use thread colors are determined based on the assumption that mixed color representation using the threads of two colors is performed. When an area is sewn using mixed color representation with the threads of two colors, the color of that area closely resembles an intermediate color that is an intermediate color between the two colors. Thus, from among the number N of the available thread colors, by using the two-color mixed color representation, it is possible to represent the number N of the available thread colors and at least one color that is the intermediate color between two colors of the number N of the available thread colors. In this case, a number N1 of the representable colors is obtained as N1=N(N+1)/2.

In the following explanation and referenced drawings, of the representable colors, an intermediate color between two colors of an available thread color cx and an available thread color cy, is represented by c[xy], for example. Further, among the representable colors, the available thread color cx itself corresponds to the intermediate color between the available thread color cx and the available thread color cx, and is therefore represented by c[xx]. In addition, in the present embodiment, in order to simplify the explanation, when mixed color representation of an area is performed, it is assumed that the threads of the two colors are mixed in an equal ratio. Thus, in a case where the RGB values of the available thread color cx are (rx, gx, bx) and the RGB values of the available thread color cy are (ry, gy, by), the RGB values of the intermediate color c[xy] are calculated as ((rx+ry)/2, (gx+gy)/2, (bx+by)/2).

The representable color list exemplified in FIG. 5 is a list generated in a case in which the available thread colors are four colors of c1, c2, c3, and c4. In actuality, the available thread colors may be normally approximately 100 colors, and the use thread colors may be approximately 10 colors. Hereinafter, in order to simplify the explanation, an example may be used in which the available thread colors are the four colors and the use thread colors are two colors. In the example of the representable color list shown in FIG. 5, the number N1 of the representable colors is 10 (=4 (4+1)/2).

As described above, from among the 10 representable colors, four colors c[11], c[22], c[33], and c[44] are, respectively, the available thread colors c1, c2, c3 and c4 themselves. In other words, the four colors c[11], c[22], c[33], and c[44] correspond to same color combinations of the color c1 with the color c1, the color c2 with the color c2, the color c3 with the color c3, and the color c4 with the color c4, respectively. As a result, in the representable color list, these four same-color combinations are stored as the corresponding available thread colors. On the other hand, six colors c[12], c[13], c[14], c[23], c[24] and c[34] are intermediate colors of combinations of two different colors from among the available thread colors c1, c2, c3 and c4. Thus, in the representable color list, the two different colors forming each of the combinations are stored as the corresponding available thread colors. Further, a usage frequency of each of the representable colors is stored in association with each of the representable colors. The usage frequency is calculated in processing at step S15, which will be explained below. At step S13, a default value zero (0) is stored as the usage frequency for all of the representable colors. In the representable color list exemplified in FIG. 5, the usage frequencies calculated at step S15 are stored. Although not shown in the drawings, the representable color list also includes RGB values for each of the available thread colors and each of the representable colors.

The original image is color-reduced so that the identified number N1 of the representable colors may be representative colors (step S14). In other words, the color of each of the plurality of pixels forming the original image is replaced by a representative color that is closest to that color. Specifically, distances in the RGB color space between the RGB values of each of the pixels and the RGB values of the number N1 of the representable colors are respectively calculated and the RGB values of each of the pixels are replaced with the RGB values of the representable color at the closest distance. In a case where the RGB values of a pixel are (Rt, Gt, Bt) and the RGB values of a representable color are (Ra, Ga, Ba), the distance d in the color space is obtained as $d=\sqrt{\{(Rt-Ra)^2+(Gt-Ga)^2+(Bt-Ba)^2\}}$.

After that, the usage frequencies of the respective representable colors are calculated, and are stored in the representable color list that is prepared in the RAM 12 at step S13 (step S15). For example, a number of the pixels that are replaced by each of the representable colors in the color reduction processing is counted, and is used as the usage frequency. In the above-described example of the four colors, the usage frequency may be calculated for each of the ten representable colors as shown in FIG. 5, for example, and may be stored.

Next, all of the combinations that select the number M of colors from among the number N of the available thread colors are identified, and information identifying the combinations is stored in the RAM 12 (step S21). At that time, the total number of combinations is $N!/\{M!(N-M)!\}$. Thus, in a case where the two colors are selected from among the four available thread colors c1, c2, c3, and c4 in the above-described example, there are six combinations of (c1, c2), (c1, c3), (c1, c4), (c2, c3), (c2, c4), and (c3, c4). In a case where the combinations are identified in this way, the representable colors that can be represented by each of the combinations are identified and then a total value of the usage frequencies of each of the combinations is calculated (step S31). The calculated total value is associated with the information identifying each of the combinations and stored in the RAM 12.

As shown in FIG. 6, for example, the representable colors that can be represented by one or two colors from the available thread colors c1 and c2 that form the combination (c1, c2) are three colors, of c[11], c[12], and c[22]. As shown in FIG. 5, in a case where the usage frequencies of c[11], c[12], and c[22] are 10, 5, and 7, respectively, the total value of the usage frequencies corresponding to the combination (c1, c2) is 22. Similarly, in a case where the total values of the usage frequencies of the other five combinations (c1, c3), (c1, c4), (c2, c3), (c2, c4), and (c3, c4) are calculated, the respective total values are 31, 14, 32, 14, and 26, as shown in FIG. 6.

The use thread colors are determined based on the total values of the usage frequencies calculated at step S31, and information identifying the use thread colors is stored in the RAM 12 (step S32). Specifically, from among the total values of the usage frequencies calculated for all of the combinations at step S31, the available thread colors of the combination corresponding to the usage frequency with the highest value are determined as the use thread colors. As there are the number M of the available thread colors included in the combinations, in this way, it is possible to determine the set number M of the use thread colors. In the example shown in FIG. 6, the combination (c2, c3) corresponds to the usage frequency highest value 32. Thus, the 2 available thread colors c2 and c3 are determined as the use thread colors. In a case where the use thread colors are determined, the CPU 11 ends the thread color determination processing shown in FIG. 4, and returns to the main processing shown in FIG. 3.

As shown in FIG. 3, in the main processing, after the thread color determination processing (step S4), color assignment processing is performed (step S5) that determines a color of each of the line segments arranged at step S3. Specifically, for each of the line segments, from among the number M of the use thread colors that are determined in the manner described above, one color that reflects the color of the original image is selected and is determined as the color of that line segment. For example, Japanese Laid-Open Patent Publication No. 2001-259268 discloses a method to select the one color that reflects the color of the original image, the relevant portions of which are incorporated by reference.

More specifically, the plurality of pixels that form the original image are sequentially taken as the target pixel, and the following processing is performed. In the original image, a predetermined area that has the target pixel at its center is set as an area (a reference area) that is used to refer to the color of the original image. Then, the color of the line segment corresponding to the target pixel is determined such that an average value of the color in the reference area of the original image is the same as an average value of the color already determined with respect to the line segments arranged in an area that is the same size as the reference area with the target pixel at its center. In other words, the colors of the respective line segments are sequentially determined based on the color of the original image and on the color of the already determined line segment. As the color of the line segment is selected from among the use thread colors, the color determined here is the color of the actual stitch.

Among the plurality of line segments to which colors have been assigned, the line segments of the same use thread color are consecutively connected, the processing in which the line segment data for each use thread color are generated is performed (step S6). For example, first, among the plurality of line segments of a use thread color, the line segment that is closest to the leftmost edge of the original image is taken as a first line segment in a connection sequence. Of two endpoints of the first line segment, one endpoint is a starting point and the other endpoint is an ending point. Next, among the other line segments of the same use thread color, a line segment having an endpoint in the closest position to the ending point of the first line segment is a second line segment to which the first line segment is connected. In the same manner, an ending point of the already connected line segment is sequentially connected to an endpoint of a line segment of the same color in the closest position. Following this, all the line segments are connected together by connecting mutually close endpoints of the same color of line segment groups that are connected for each of the use thread colors. Then, connected line segment data are generated, which are data that indicate the positions (coordinates) of the endpoints of all of the connected line segments, a connecting sequence, and the use thread color.

The embroidery data are generated based on the connected line segment data (step S7). Specifically, coordinates of needle drop points are calculated by converting the coordinates of the endpoints of the line segments to coordinates in the X-Y coordinate system that is unique to the sewing machine 3. Further, the connecting sequence of the line segments becomes a sewing order of the needle drop points. In this way, the embroidery data are generated that indicate the coordinates of the needle drop points, the sewing order, and the use thread color. When the generating of the embroidery data is complete, the embroidery data generation processing shown in FIG. 3 ends.

As described above, according to the embroidery data generation apparatus 1 of the first embodiment, the number N of the available thread colors and the intermediate colors of two colors from among the number N of the available thread colors are identified as the representable colors. Then, the usage frequency of each of the representable colors is calculated in a case where the original image has been color-reduced, to obtain representative colors of the representable colors. Thus, even when the color close to the available thread color itself does not exist in the original image, if a lot of colors close to the intermediate color are included in the original image, the usage frequency of the intermediate color is higher. As a result, including cases of mixed color representation using two colors rather than just one color from among the available thread colors, it is possible to select the use thread color that is appropriate to represent the color of the original image. In particular, in the present embodiment, among all the combinations that select the number M of colors from among the number N of the available thread colors, the number M of the available thread colors that are included in the combination that has the highest usage frequency total value are determined as the use thread colors. It is therefore possible to select the use thread color that can represent the color closest to the color of the original image.

Second Embodiment

Hereinafter, a second embodiment will be explained with reference to FIG. 5 to FIG. 7. Configurations of the embroidery data generation apparatus 1 and the sewing machine 3 of the second embodiment and of third and fourth embodiments to be explained below are the same as those of the first embodiment, and an explanation thereof is therefore omitted below. Further, main processing according to the second embodiment and the third and fourth embodiments to be explained below differs from the main processing of the first embodiment only in the content of the thread color determination processing (refer to step S4 of FIG. 3, and FIG. 4). Therefore, in the following explanation, processing that is the same as that of the first embodiment is denoted with the same step number and an explanation thereof is omitted or simplified, while processing that differs from that of the first embodiment is explained in detail.

Figure 7:
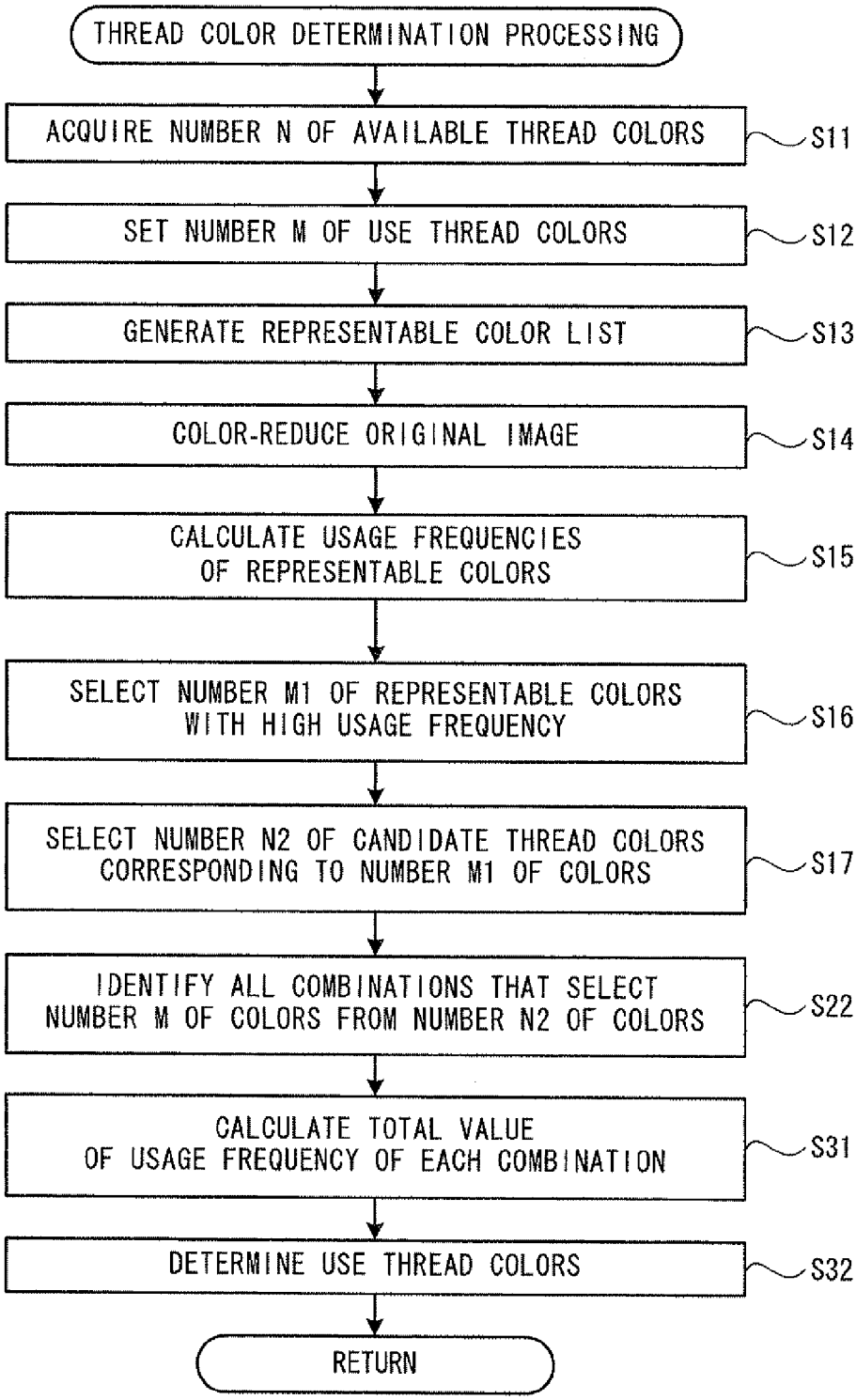
FIG. 7 is a flowchart of thread color determination processing according to a second embodiment.

As shown in FIG. 7, in the thread color determination processing of the second embodiment, processing to acquire information identifying the available thread colors, to identify the number N1 of the representable colors, and to calculate the usage frequency of each of the representable colors in the original image (steps S11 to S15) is the same as that of the first embodiment (refer to FIG. 4). After that, in the first embodiment, all the combinations that select the number M of colors from among the number N of the available thread colors are identified. In the second embodiment, in order to reduce the number of combinations, it is attempted to narrow down the number of available thread colors that are made use of in the combinations. Specifically, first, in descending order of the usage frequencies calculated at step S15, a number M1 of the representable colors is selected from among the number N1 (=N (N+1)/2) of the representable colors (step S16). The number M1 is an integer that is smaller than the number N1. The number M1 may be a value that is set in advance and stored in the setting value storage area 154 of the HDD 15. The number M1 may be a value that is input by the user.

Next, from among the number N of the available thread colors, the available thread colors that are needed to represent the selected number M1 of the representable colors using one color or two colors are selected as candidate thread colors, and information of the candidate thread colors is stored in the RAM 12 (step S17). In a case where the number M1 of colors are all intermediate colors, and the available thread colors that form the intermediate colors are all different, a number N2 of the candidate thread colors is twice as large as the number M1. In this case, the number N2 is a highest value. However, the number N2 of the candidate thread colors is less than the total number N of the available thread colors. Therefore, in a case where the number M1 of the representable colors selected at step S16 is less than one half of the total number N of the available thread colors (M1<N/2), it is possible to reliably reduce the number N2 of the candidate thread colors to less than the number N. For example, in a case where the total number N of the available thread colors is 100 colors, the number N1 of the representable colors is 5,050 colors. In a case where the number M1 of representable colors that are selected from the 5,050 representable colors in descending order of usage frequency is ten, the number N2 of the candidate thread colors corresponding to the ten representable colors may be a maximum 20 colors.

Even in a case where the selected number M1 of the representable colors includes the same available thread colors, there are cases in which it is possible to reduce the number N2 of the candidate thread colors to less than the number N. For example, in a case where the three colors c[33], c[11], and c[23] are selected in descending order of usage frequency from the ten representable colors shown in FIG. 5, the candidate thread colors are the three colors c1, c2, and c3. In other words, the number N2 of the candidate thread colors is three, which is smaller than the total number N of the available thread colors, which is four.

All the combinations that select the number M of colors from among the number N2 of the candidate thread colors are identified, and information of the identified combinations is stored in the RAM 12 (step S22). At this time, the total number of the combinations is $N2!/\{M!(N2-M)!\}$. For example, in a case where the candidate thread colors are not narrowed down, there are 17.3 trillion combinations that select the ten colors from among all the 100 available thread colors. On the other hand, by narrowing down the representable colors in the manner described above, and thus narrowing down the 100 available thread colors to the 20 candidate thread colors, there are 184,756 combinations in a case where the set number M of the use thread colors is ten. Namely, it is possible to significantly reduce the number of combinations.

In a case where the combinations are identified, in the same manner as the first embodiment, the representable colors that can be represented by each of the combinations are identified and the total value of the usage frequency of each of the combinations is calculated (step S31). Then, from among the total values of the usage frequencies, the available thread colors of the combination corresponding to the usage frequency with the highest value are determined as the use thread colors (step S32), and the thread color determination processing shown in FIG. 7 ends.

As described above, in the thread color determination processing of the second embodiment, there are cases in which it is possible to reduce the number N of the available thread colors used in the combinations to the number N2, which is smaller than the number N, in accordance with the number M1 of the representable colors in descending order of usage frequency from among the number N1 of the representable colors. In this case, the number of combinations that select the number M of colors from among the number N2 of colors is smaller than the number of combinations that select the number M of colors from among the number N of the available thread colors. In a case where the number of combinations is reduced, a calculation time required to determine the use thread colors may be reduced. Specifically, it is possible to reduce the calculation time to identify the combinations at step S22 and the time to calculate the total values of the usage frequencies corresponding to each of the combinations at step S31. In particular, when there is a great difference between the total number N of the available thread colors and the set number M, there may be clear benefits obtained by reducing the number of combinations. In this way, according to the thread color determination processing of the second embodiment, the use thread colors that can represent the colors close to the colors of the original image may be more effectively selected.

Third Embodiment

Hereinafter, the third embodiment will be explained with reference to FIG. 5, FIG. 8, and FIG. 9. As above, the following explanation mainly includes a detailed explanation of thread color determination processing that differs from the first embodiment.

Figure 8:
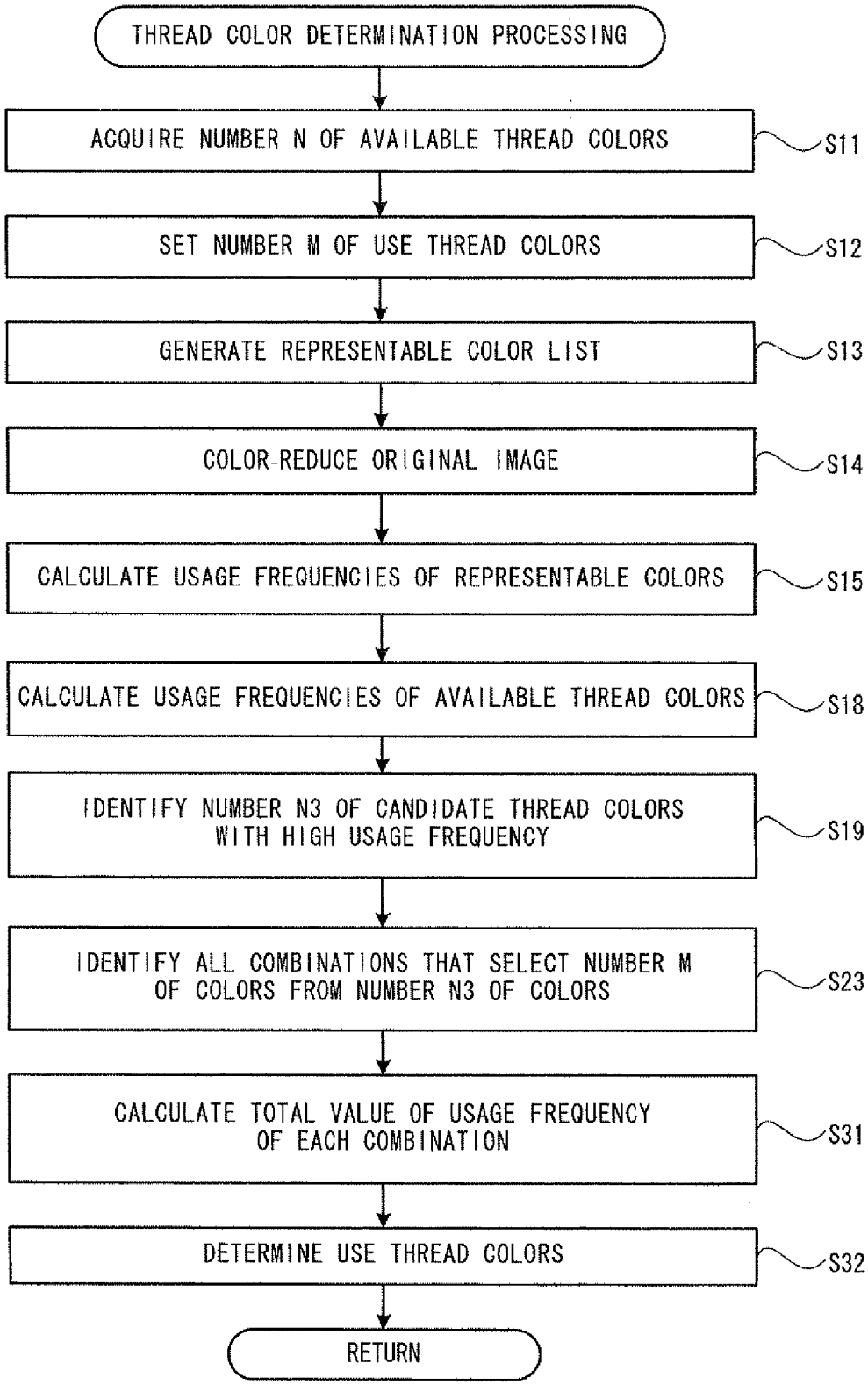
FIG. 8 is a flowchart of thread color determination processing according to a third embodiment.

As shown in FIG. 8, in thread color determination processing according to the third embodiment, processing to acquire information identifying the available thread colors, to identify the number N1 of the representable colors, and to calculate the usage frequency of each of the representable colors in the original image (steps S11 to S15) is the same as that of the first embodiment (refer to FIG. 4). After that, in the third embodiment, similarly to the second embodiment, it is attempted to narrow down the number of available thread colors that are made use of in the combinations. However, in the third embodiment, a method to narrow down the available thread colors is different to that of the second embodiment.

Specifically, first, based on the usage frequencies of the number N1 of the representable colors calculated at step S15, the usage frequencies of each of the number N of the available thread colors are calculated (step S18). For example, it is assumed that the usage frequencies of the ten representable colors are calculated at step S15, as shown in FIG. 5. In this case, the usage frequencies of the four colors c1, c2, c3, and c4 that are the available thread colors may be respectively calculated in the following manner. The available thread color c1 may be used in the four representable colors c[11], c[12], c[13], and c[14], and the respective usage frequencies may be 10, 5, 6, and 1. Of these four colors, the color c[11] is equivalent to the intermediate color of c1 and c1 and thus, in the present embodiment, the color c1 may be regarded as being used twice. As a result, the usage frequency of the color c1 may be calculated to be 32 (=10+10+5+6+1). Similarly, the usage frequencies of the colors c2, c3, and c4 may be respectively calculated to be 33, 54, and 19, as shown in FIG. 9.

In descending order of the calculated usage frequencies, a number N3 of colors from among the number N of the available thread colors are selected as the candidate thread colors, and information of the candidate thread colors is stored in the RAM 12 (step S19). The number N3 of the candidate thread colors is an integer that is equal to or larger than the set number M and that is also less than the total number N of the available thread colors. The number N3 may be a value that is set in advance and stored in the setting value storage area 154 of the HDD 15. The number N3 may be a value that is input by the user. In the example shown in FIG. 9, in a case where the three candidate thread colors are selected from among the four available thread colors, the colors c3, c2, and c1 corresponding to the usage frequencies 54, 33, and 32 may be selected.

Next, all of the combinations that select the number M of colors from among the number N3 of the candidate thread colors are identified, and information of the identified combinations is stored in the RAM 12 (step S23). At this time, the total number of the combinations is N3!/{M!(N3−M)!}. Thus, for example, in a case where the 100 available thread colors are narrowed down to the 20 candidate thread colors, based on the usage frequencies of the available thread colors which are calculated based on the usage frequencies of the representable colors, there may be 184,756 combinations when the set number M of the use thread colors is 10. Thus, similarly to the second embodiment, by narrowing down the number of the candidate thread colors, it is possible to reduce the calculation time.

In the second embodiment, the number N2 of the candidate thread colors may vary in accordance with a ratio of the same available thread color that is included in the number M1 of the representable colors that are narrowed down based on the usage frequencies. Namely, in a case in which all of the number M1 of the representable colors are intermediate colors of two different available thread colors, it is possible that the number N2 of the candidate thread colors does not vary from the total number N of the available thread colors. For example, it is assumed that the two representable colors c[12] and c[34] with high usage frequencies are selected from among the ten representable colors corresponding to the four available thread colors c1, c2, c3, and c4. In this case, the candidate thread colors are the four colors c1, c2, c3, and c4, and thus there is no change with the available thread colors. In the present embodiment, it is possible to select the number N3 of the candidate thread colors in descending order of usage frequency from among the number N of the available thread colors. Thus, the number N3 of the candidate thread colors may be more reliably reduced. As a result, it is possible to reliably reduce the number of combinations.

In a case where the combinations are identified, similarly to the first embodiment, the representable colors that can be represented by each of the combinations are identified and the total value of the usage frequency of each of the combinations is calculated (step S31). Then, from among the total values of the usage frequencies, the available thread colors of the combination corresponding to the usage frequency with the highest value are determined as the use thread colors (step S32), and the thread color determination processing shown in FIG. 8 ends.

As described above, in the thread color determination processing of the third embodiment, the respective usage frequencies of the number N of the available thread colors are calculated based on the usage frequencies of the number N1 of the representable colors. Then, the available thread colors that are used in the combinations are narrowed down in descending order of the calculated usage frequencies to the number N3 of colors, which is smaller than the number N of colors. It is thus possible to reliably reduce the number of combinations. The more the number N3 of the candidate thread colors selected at step S19 is reduced, the more it is possible to reduce the calculation times at steps S23 and S31. In a case where, for example, the number N3 of the candidate thread colors is the same as the set number M of the use thread colors, there is only one combination that selects the number M of colors from among the number N3 of the candidate thread colors. As a result, at step S23, no calculation time is required to identify the combination. In addition, at step S31, the total value of the usage frequency is calculated for that one combination only. The calculation time may therefore be reduced in comparison to the case in which the total values are calculated for all the combinations that select the number M of colors from among the number N of colors. In this way, according to the thread color determination processing of the third embodiment, the use thread colors that can represent the colors close to the colors of the original image may be effectively selected.

Fourth Embodiment

Hereinafter, the fourth embodiment will be explained with reference to FIG. 10 and FIG. 11. As above, the following explanation mainly includes a detailed explanation of thread color determination processing that differs from the first embodiment.

Figure 10:
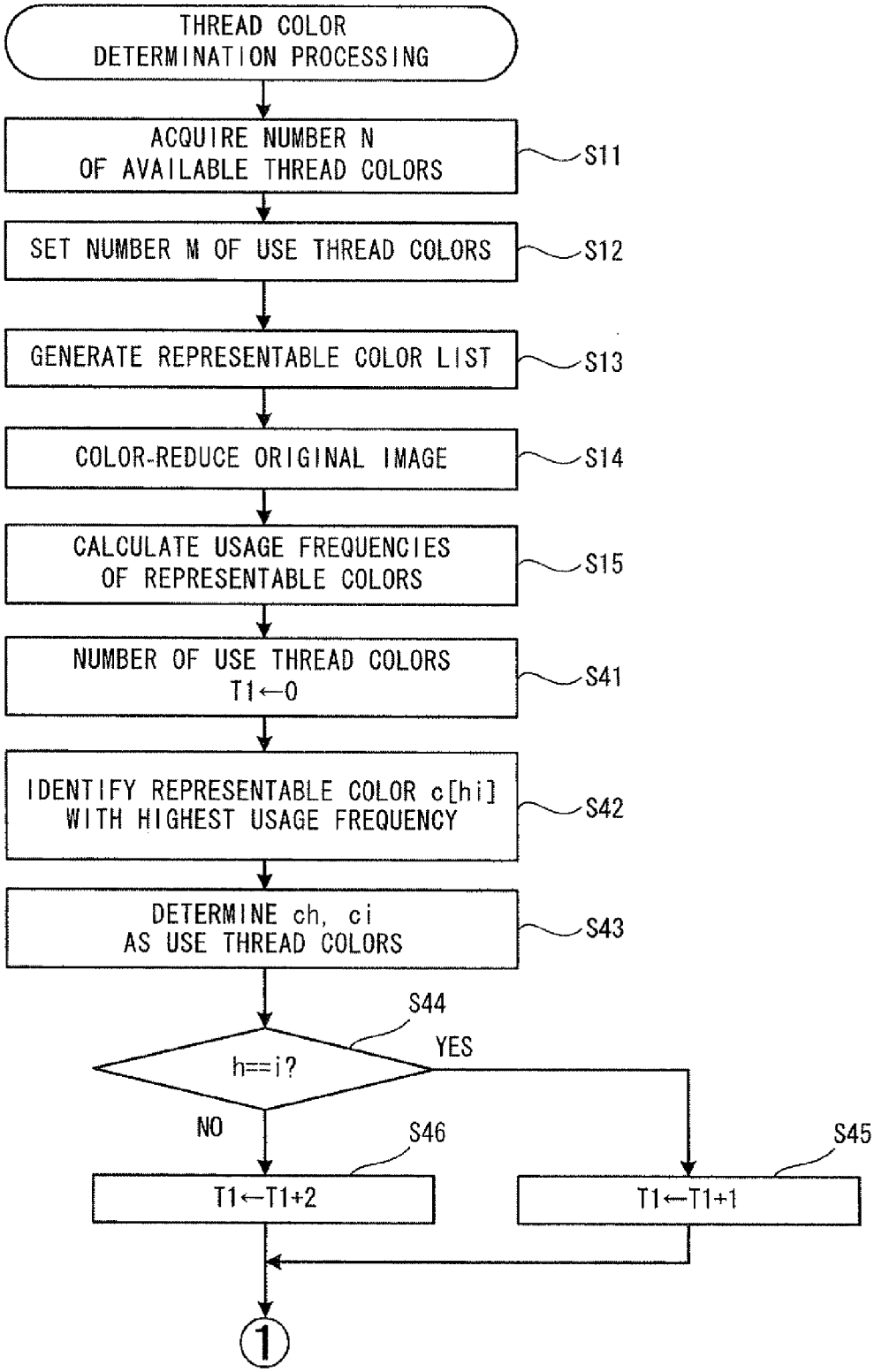
FIG. 10 is a flowchart of thread color determination processing according to a fourth embodiment.

As shown in FIG. 10, in the thread color determination processing of the fourth embodiment, processing to acquire information identifying the available thread colors, to identify the number N1 of the representable colors, and to calculate the usage frequency of each of the representable colors in the original image (steps S11 to S15) is the same as that of the first embodiment (refer to FIG. 4). After that, in the second and third embodiments, after the available thread colors that are made use of in the combinations are narrowed down, the total values of usage frequencies are calculated for each of all the combinations that select the number M of colors from among the narrowed down available thread colors. Then, the available thread colors corresponding to the combination with the highest total value are determined as the use thread colors. On the other hand, in the fourth embodiment, two colors or one color of the use thread colors are first determined. Then, from among the remaining available thread colors, an available thread color is added as a use thread color one color at a time until the number M is reached. Here, the available thread color is added in order from an available thread color having the highest usage frequency when used in combination with the already determined use thread color.

Specifically, first, a variable T1 for counting a number of the already determined use thread colors is set to zero (0) (step S41). Next, a representable color c[hi], which has the highest usage frequency calculated at step S15, is identified (step S42). Then, available thread colors ch and ci corresponding to the identified representable color are determined as the use thread colors, and information identifying the determined use thread colors is stored in the RAM 12 (step S43). h and i are both an integer from one to N. As described above, the representable color is a color represented by one color or two colors of the available thread colors. If h and i are the same (yes at step S44), c[hi] refers to an intermediate color of the same color of the available thread colors, and c[hi] is one color of the available thread colors. As a result, one color is determined as the use thread color in this case, and thus one is added to the variable T1 (step S45). On the other hand, if h and i are not the same (no at step S44), c[hi] refers to an intermediate color between two colors of the available thread colors. As a result, two colors are determined as the use thread colors in this case, and thus two is added to the variable T1 (step S46).

Figure 11:
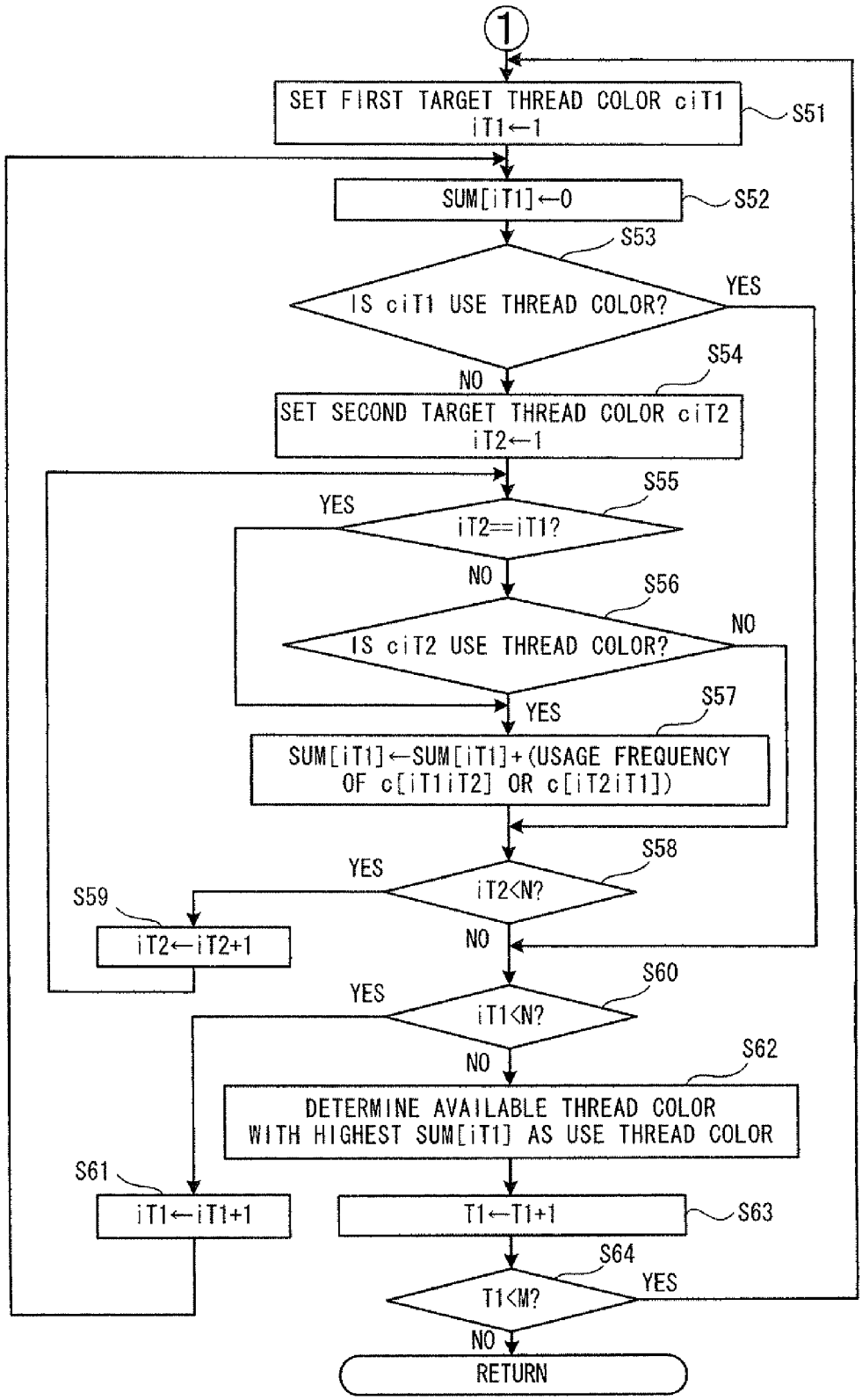
FIG. 11 is a flowchart of the thread color determination processing according to the fourth embodiment and is a continuation of FIG. 10.

As shown in FIG. 11, next, a variable iT1 that represents a first target thread color ciT1 is set to one and is stored in the RAM 12, and the available thread color c1, which is a first color of the number N of the available thread colors, is set as the first target thread color ciT1 (step S51). The variable iT1 is an integer from one to N. The first target thread color ciT1 is, of the available thread colors, one color that is a target of a determination as to whether or not the thread color will become a use thread color in addition to the already determined use thread colors.

A variable SUM[iT1] that indicates the total value of the usage frequency of the first target thread color ciT1 is set to zero (0), and is stored in the RAM 12 in association with the value of the variable iT1 (step S52). It is determined whether information indicating the first target thread color ciT1 is stored in the RAM 12 as information of the already determined use thread color (step S53). If the first target thread color ciT1 is already determined as the use thread color (yes at step S53), the processing of that color is complete. It is therefore then determined whether the variable iT1 is less than the total number N of the available thread colors (step S60). If the variable iT1 is less than the total number N (yes at step S60), the unprocessed available thread colors are remaining that have not yet been taken as the first target thread color ciT1. Therefore, one is added to the variable iT1 (step S61), the next available thread color is taken as the first target thread color ciT1, and the processing returns to step S52.

If it is determined, at step S53, that the first target thread color ciT1 is not the use thread color (no at step S53), a variable iT2 that represents a second target thread color ciT2 is set to one and is stored in the RAM 12, and the available thread color c1, which is the first color of the number N of the available thread colors, is set as the second target thread color ciT2 (step S54). The variable iT2 is an integer from 1 to N. In the present embodiment, in a case where the second target thread color ciT2 is the already determined use thread color or is the same color as the first target thread color ciT1, mixed color representation using the first target thread color ciT1 and the second target thread color ciT2 is considered. Here, first, it is determined whether or not the variable iT2 and the variable iT1 are the same, namely, whether or not the first target thread color ciT1 and the second target thread color ciT2 are the same color (step S55).

If the variable iT2 and the variable iT1 are the same (yes at step S55), from among the usage frequencies of the number N1 of the representable colors calculated at step S15 in FIG. 10, the usage frequency of an intermediate color c[iT1iT2], which is an intermediate color of the first target thread color ciT1 and the second target thread color ciT2, is added to the variable SUM[iT1], which indicates the total value of the usage frequency of the first target thread color ciT1 stored in the RAM 12, and the variable SUM[iT1] is updated (step S57). In this case, the intermediate color c[iT1iT2] is one color of the available thread colors that are not yet determined as the use thread colors. When the variable SUM[iT1] is updated, the processing advances to step S58.

If the variable iT2 is not the same as the variable iT1 (no at step S55), it is determined whether or not the second target thread color ciT2 is stored in the RAM 12 as the already determined use thread color (step S56). If the second target thread color ciT2 is determined as the use thread color (yes at step S56), the usage frequency of the intermediate color c[iT1iT2], which is the intermediate color of the first target thread color ciT1 and the second target thread color ciT2, is added to the variable SUM[iT1] stored in the RAM 12, and the variable SUM[iT1] is updated (step S57). In this case, the intermediate color c[iT1iT2] is an intermediate color of one color of the available thread colors that are not yet determined as the use thread color and one color that is already determined as the use thread color. When the variable SUM[iT1] is updated, the processing advances to step S58.

If the second target thread color ciT2 is not determined as the use thread color (no at step S56), the usage frequency is not added to the variable SUM[iT1], and the processing advances to step S58. At step S58, it is determined whether the variable iT2 is less than the total number N of the available thread colors. If the variable iT2 is less than the total number N (yes at step S58), there are the remaining unprocessed available thread colors that have not yet been taken as the second target thread color ciT2. Therefore, one is added to the variable iT2 (step S59), the next available thread color is taken as the second target thread color ciT2, and the processing returns to step S55.

The processing from steps S55 to S59 is repeated in the manner described above. If the variable iT2 is no longer less than the total number N of the available thread colors (no at step S58), it is determined whether the variable iT1 is less than the total number N of the available thread colors (step S60). If the variable iT1 is less than the total number N (yes at step S60), one is added to the variable iT1 (step S61), the next available thread color is taken as the first target thread color ciT1, and the processing returns to step S52. At this point in time, stored in the RAM 12 is the total value of the usage frequency of the representable color that can be represented by one color or two colors from among the first target thread color ciT1 on which processing is complete and the already determined use thread colors.

The processing at steps S52 to S61 is repeated in the manner described above, and the total value of the usage frequency of the representable color that can be represented by one color or two colors, from among the available thread colors that have not yet been determined as the use thread colors and the already determined use thread colors, are calculated in order and stored in the RAM 12. In this process, in a case where the variable iT1, which represents the first target thread color ciT1, becomes larger than the variable iT2, which represents the second target thread color ciT2 (iT1>iT2), at step S57, the usage frequency of the intermediate color c[iT2iT1] may be added to the variable SUM[iT1] stored in the RAM 12.

If all the number N of the available thread colors have been taken as the first target thread color ciT1 and the variable iT1 is not less than the total number N (no at step S60), from among the variables SUM[iT1] that are respectively stored in the RAM 12 in association with the variable iT1 values, the highest value is identified. The available thread color ciT1 corresponding to the identified highest value is determined as the use thread color, and that information is stored in the RAM 12 (step S62). One is added to the variable T1 that indicates the number of use thread colors (step S63). If the variable T1 is less than the set number (the number of use thread colors) M (yes at step S64), the processing returns to step S51 and the available thread color c1 that is the first color is once more taken as the first target thread color (step S51). Then, as described above, from among the remaining available thread colors, the processing is repeated to determine, as the use thread color, the available thread color having the highest usage frequency when used in combination with a number T1 of the already determined use thread colors (steps S51 to S64). As a result, if the number T1 of the already determined use thread colors reaches the set number M and is no longer less than the set number M (no at step S64), the thread color determination processing shown in FIG. 10 and FIG. 11 ends.

As shown in FIG. 5, after calculating the usage frequencies corresponding to of the respective representable colors with respect to the four available thread colors c1, c2, c3, and c4, in a case where the example in which the two use thread colors are determined is applied to the thread color determination processing of the present embodiment, the processing may be as follows. First, the available thread colors c3 and c3 corresponding to the representable color c[33] that has the highest usage frequency (15) may be determined as the use thread colors (step S43 in FIG. 10). The color c[33] corresponds to an intermediate color of the same colors (yes at step S44), and thus the number T1 of the determined use thread colors may be set to 1 (step S45).

As the first target thread color c1 is not the use thread color (no at step S53 in FIG. 11), the second target thread color c1 may be set (step S54). In a first cycle of the processing from steps S55 to S59, the first target thread color c1 and the second target thread color c1 may be the same color (yes at step S55). Therefore, the usage frequency (10) of the representable color c[11] may be stored as the total value SUM[1]) of the usage frequencies (step S57). In a second cycle of the processing, the second target thread color c2 may not be the same color as the first target thread color c1 and may not be the already determined use thread color (no at step S55 and no at step S56). Therefore, the total value of the usage frequencies may not be updated. In a third cycle of the processing, the second target thread color c3 may be the already determined use thread color (yes at step S56). Therefore, the usage frequency (6) of the representable color c[13] may be added to the usage frequency (10) calculated in the first cycle of the processing, and the total value of the usage frequencies may be updated to 16 (step S57). In a fourth cycle of the processing, the second target thread color c4 may not be the same color as the first target thread color el and may not be the already determined use thread color (no at step S55 and no at step S56). Therefore, the total value of the usage frequencies may not be updated.

The next set first target thread color c2 may not be the use thread color (no at step S53). Therefore, the second target thread color c1 may be set (step S54). In the first cycle of the processing from steps S55 to S59, the second target thread color c1 may not be the same color as the first target thread color c2 and may not be the already determined use thread color (no at step S55 and no at step S56). Therefore, the total value of the usage frequencies may not be updated. In the second cycle of the processing, the second target thread color c2 may be the same color as the first target thread color c2 (yes at step S55). Therefore, the usage frequency (7) of the representable color c[22] may be stored as the total value (SUM [2]) of the usage frequencies (step S57). In the third cycle of the processing, the second target thread color c3 may be the already determined use thread color (yes at step S56). Therefore, the usage frequency (10) of the representable color c[23] may be added to the usage frequency (7) calculated in the second cycle and the total value of the usage frequencies may be updated to 17 (step S57). In the fourth cycle of the processing, the second target thread color c4 may not be the same color as the first target thread color c2 and may not be the already determined use thread color (no at step S55 and no at step S56). Therefore, the total value of the usage frequencies may not be updated.

The next set first target thread color c3 may be the use thread color (yes at step S53). Therefore, the next first target thread color c4 may be immediately set (step S61). The first target thread color c4 may not be the use thread color (no at step S53). Therefore, the second target thread color c1 may be set (step S54). In the first cycle of the processing from steps S55 to S59, the second target thread color c1 may not be the same color as the first target thread color c4 and may not be the already determined use thread color (no at step S55 and no at step S56). Therefore, the total value of the usage frequencies may not be updated. In the second cycle of the processing, the second target thread color c2 may not be the same color as the second target thread color c4 and may not be the already determined use thread color (no at step S55 and no at step S56). Therefore, the total value of the usage frequencies may not be updated. In the third cycle of the processing, the second target thread color c3 may be the already determined use thread color (yes at step S56). Therefore, the usage frequency (8) of the representable color c[34] may be stored as the total value (SUM[4]) of the usage frequencies (step S57). In the fourth cycle of the processing, the second target thread color c4 may be the same color as the first target thread color c4 (yes at step S55). Therefore, the usage frequency (3) of the representable color c[44] may be added to the usage frequency (8) calculated in the third cycle and the total value of the usage frequencies may be updated to 11 (step S57).

As all of the four colors c1 to c4 have been taken as the first target thread color (no at step S60), the values 16, 17, and 11 of the usage frequency total values SUM[1], SUM[2] and SUM[4] may be compared and the available thread color c2 corresponding to the highest value of 17 may be newly determined as the use thread color (step S62). The number T1 of determined use thread colors may become two (step S63) and the number T1 may have reached the set number M (no at step S64), therefore the thread color determination processing may end. In this way, the two use thread colors c3 and c2 may be determined in order.

As described above, in the thread color determination processing of the fourth embodiment, first, from among the number N of the available thread colors, 1 or 2 of the available thread colors corresponding to the representable color with the highest usage frequency are determined as the use thread colors. After that, from among the remaining available thread colors, processing is repeated to determine, as the use thread color, the available thread color whose usage frequency total value is the highest when it is used alone and when it is used for mixed color representation with the already determined use thread color. This processing is repeated until the number of the use thread colors reaches the set number M.

For example, in a case where one color is initially determined as the use thread color, (N−1) combinations require calculation of the usage frequency total value in the processing to determine the second color, (N−2) combinations require this calculation in the processing to determine the third color, and so on. In the processing to determine the M-th color, (N−M+1) combinations require calculation of the usage frequency total value. As a result, the total number of combinations requiring calculation of the usage frequency total value is $(M-2)\{(N-2)+(N-M+1)\}/2$. For example, in a case where ten use thread colors are determined from among 100 available thread colors, the number of combinations is 756. It is thus possible to greatly reduce the number of combinations in comparison to the case in which the total values are calculated for the combinations (17.3 trillion combinations) that select the number M of colors from among the number N of colors, and in comparison to the case in which the total values are calculated for the combinations (184,756 combinations) that select the number M of colors from among the candidate thread colors that are fewer than the number N of colors. In this way, according to the thread color determination processing of the fourth embodiment, it is possible to select the use thread colors that are suitable to represent the original image using mixed color representation of one or two of the available thread colors, while reducing the number of available thread color combinations that require calculation of the usage frequency total value.

In the thread color determination processing of the fourth embodiment, it is not necessary to select the candidate thread colors as in the second embodiment and the third embodiment. Furthermore, the total values of the usage frequencies including the intermediate color are calculated. As a result, it is possible to select the use thread colors that are suitable to represent the whole image.

The present invention is not limited to the above-described embodiments, and various modifications are possible. For example, in the above-described embodiments, it is not taken into account what kind of color the representable colors will be. The number N1 (=N(N+1)/2) of representable thread colors are identified, and the representable color list is generated. However, processing may be performed such that intermediate colors which conceivably have a poor effect when used in mixed color representation are not included in the representable color list. Representable color list generation processing that is performed in such a case will be explained with reference to FIG. 12. Representable color list generation processing shown in FIG. 12 may be performed in place of the processing at step S13 in the thread color determination processing of the first to fourth embodiments (refer to FIG. 4, FIG. 7, FIG. 8, and FIG. 10).

Figure 12:
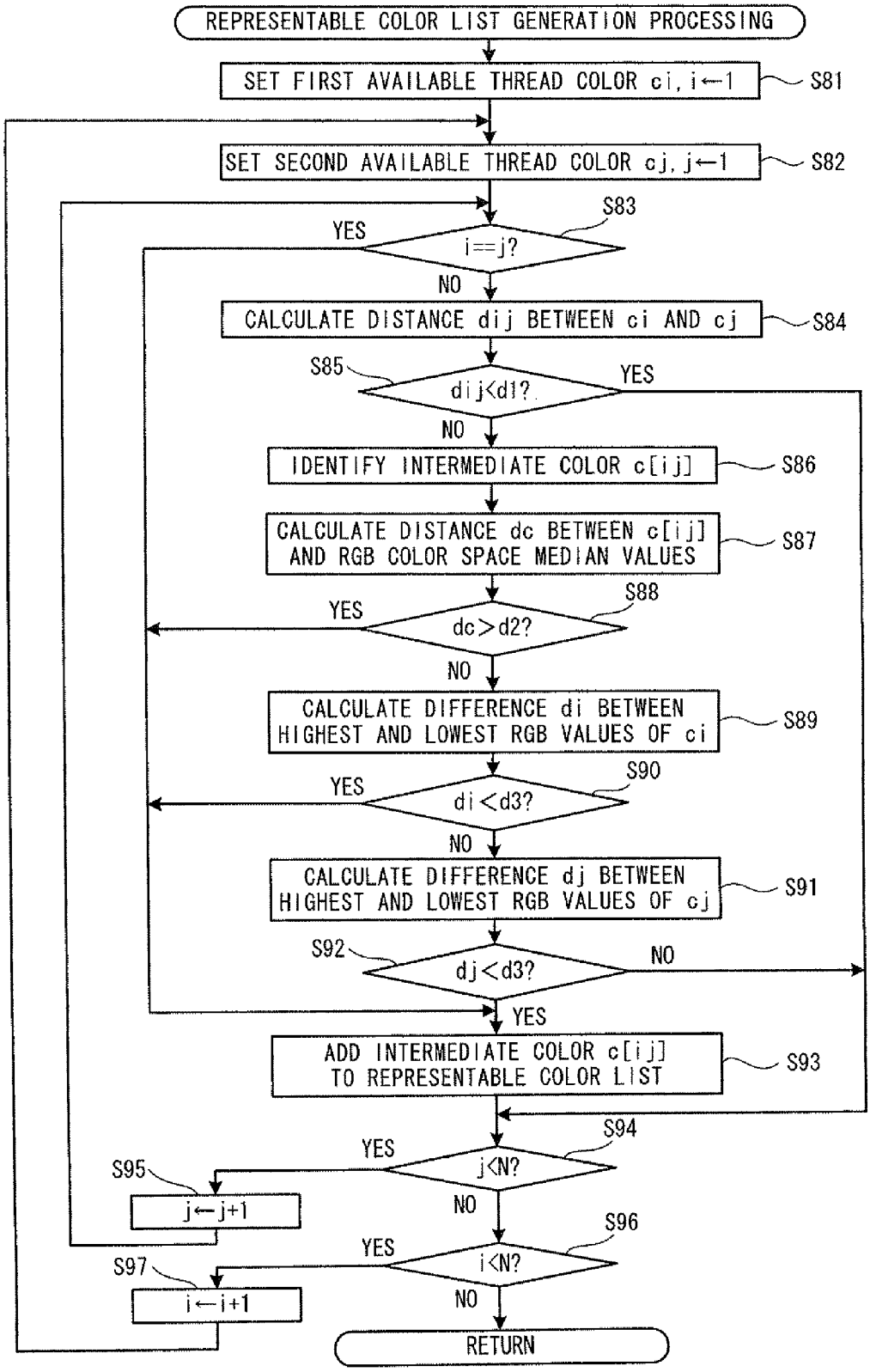
FIG. 12 is a flowchart of representable color list generation processing.

As shown in FIG. 12, first, a variable i that represents a first available thread color ci is set to 1 and the set variable i is stored in the RAM 12, and the available thread color c1 that is the first color from among the number N of the available thread colors is set as the first available thread color ci (step S81). The variable i is an integer from 1 to N. Further, a variable j that represents a second available thread color cj is set to 1 and the set variable j is stored in the RAM 12, and the first color available thread color c1 from among the number N of the available thread colors is set as the second available thread color cj (step S82). The variable j is an integer from 1 to N. The first available thread color ci and the second available thread color cj are, from among the available thread colors, the two colors for which a determination will be made as to whether or not to include the intermediate color between these two colors on the representable color list, namely, as to whether or not to perform mixed color representation using these two colors.

It is determined whether the variable i and the variable j are the same (step S83). In the initial processing, the variable i and the variable j are both 1 and are thus both the same (yes at step S83). In other words, the first available thread color c1 and the second available thread color c1 are the same available thread color. In this case, the intermediate color c[ij], namely the color c[11] is the available thread color c1 itself and thus the color c[11] and the corresponding available thread colors c1 and c1 are added to the representable color list (refer to FIG. 5) (step S93). It is determined whether or not the variable j is less than the total number N of the available thread colors, namely, whether the combinations of the first available thread color ci and each of the available thread colors have been processed (step S94). If the variable j is less than the number N (yes at step S94), one is added to the variable j (step S95) and the processing returns to step S83.

If the variable j and the variable i are not the same (no at step S83), the first available thread color ci and the second available thread color cj are the available thread colors having two different colors. In this case, a distance dij in an RGB color space between the first available thread color ci and the second available thread color cj is calculated (step S84). In a case where the RGB values of the first available thread color ci are (Ri, Gi, Bi) and the RGB values of the second available thread color cj are (Rj, Gj, Bj), the distance dij in the RGB color space is obtained as $dij=\sqrt{\{(Ri-Rj)^2+(Gi-Gj)^2+(Bi-Bj)^2\}}$.

It is determined whether or not the calculated distance dij is less than a predetermined threshold d1 (step S84). The threshold value d1 is set in advance and stored in the setting value storage area 154 of the HDD 15. The threshold value d1 may be, for example, a value (expressed by a distance in the RGB color space) that indicates a limit value of a range in which two different colors are recognized by the human eye as being somewhat similar to each other. When the distance dij is less than the threshold value d1 (yes at step S85), the first available thread color ci and the second available thread color cj are colors that are somewhat similar to each other. Therefore, the intermediate color of these two colors may be a color that is even more similar to each of the first available thread color ci and the second available thread color cj. It is thus conceivable that mixed color representation using these two colors is not particularly effective. Therefore, the intermediate color c[ij] is not added to the representable color list and the processing advances to step S94. If the distance dij is not less than the threshold value d1 (no at step S84), the intermediate color c[ij] is identified (step S86). Specifically, as described with respect to the processing at step S13 of the first embodiment, the RGB values of the intermediate color c[ij] are calculated from the RGB values of the first available thread color ci and the RGB values of the second available thread color cj.

Next, processing is performed to determine whether the intermediate color c[ij] is a gray color obtained from two chromatic colors (step S87 to step S92). Even if a gray intermediate color is obtained by the calculation, it is difficult to represent a color that is similar to gray using mixed color representation with the two chromatic color threads. In other words, it is conceivable that an effect obtained by performing mixed color representation is poor. Therefore, if it is determined that the intermediate color c[ij] is a gray color obtained from two chromatic colors, processing is performed in which the intermediate color c[ij] is not included in the representable color list, and if it is determined that the intermediate color c[ij] is not the gray color obtained from two chromatic colors, processing is performed in which the intermediate color c[ij] is included in the representable color list.

In general, the intermediate color of two chromatic colors is substantially the gray color in terms of the calculation in a case where the following four conditions are all satisfied. A first condition is that the RGB values of the two colors are not the same. A second condition is that a distance between median values (127.5, 127.5, 127.5) in the RGB color space and the intermediate color is to some extent close. Third and fourth conditions are that a difference between a highest RGB value and a lowest RGB value of one of the two colors is to some extent large, and a difference between a highest RGB value and a lowest RGB value of the other of the two colors is to some extent large, respectively. By the above-described processing at step S83, only in a case where the first condition is satisfied, processing from step S87 onwards is performed. Thus, at steps S87 to S92, the second, third, and fourth conditions are determined in order.

First, a distance dc between the intermediate color c[ij] and the median values (127.5, 127.5, 127.5) in the RGB color space is calculated (step S87). Then, it is determined whether or not the distance dc is larger than a predetermined threshold value d2 (step S88). The median values (127.5, 127.5, 127.5) in the RGB color space correspond to gray. The threshold value d2 is set in advance and stored in the setting value storage area 154 of the HDD 15. The threshold value d2 may be set in a similar manner to the threshold value d1. The threshold value d1 and the threshold value d2 may be the same or may be different. If the distance dc is larger than the predetermined threshold value d2 (yes at step S88), the second condition is not satisfied and the intermediate color c[ij] is not a color that is to some extent close to gray. Thus, the intermediate color c[ij] is added to the representable color list (step S93) and the processing advances to step S94.

If the distance dc is not less than the predetermined threshold value d2 (no at step 88), the second condition is satisfied and the intermediate color c[ij] is a color that is to some extent close to gray. Further, a difference di between the highest RGB value and the lowest ROB value of the first available thread color ci is calculated (step S89), and it is determined whether the difference di is less than a threshold value d3 (step S90). The threshold value d3 is set in advance and stored in the setting value storage area 154 of the HDD 15. In the case of an achromatic color, all of the RGB values are the same. In the case of a chromatic color, at least two of the ROB values are mutually different. Specifically, in a case where there is a difference between the highest RGB value and the lowest RGB value, that color is a chromatic color. However, in a case where that difference is tiny, the color is close to an achromatic color. Therefore, as the threshold value d3, for example, it is sufficient to set a distance of an extent that makes it possible to clearly recognize that the color is a chromatic color. If the difference di is less than the threshold value d3 (yes at step S90), the third condition is not satisfied and the first available thread color ci is considered to be an achromatic color. Thus, the intermediate color c[ij] is added to the representable color list (step S93) and the processing advances to step S94.

If the difference di is not less than the threshold value d3 (no at step S90), the third condition is satisfied, and the first available thread color ci is considered to be a chromatic color. Therefore, additionally, a difference dj between the highest RGB value and the lowest RGB value of the second available thread color cj is calculated (step S91), and it is determined whether the difference dj is less than the threshold value d3 (step S92). If the difference dj is less than the threshold value d3 (yes at step S92), the fourth condition is not satisfied and the second available thread color cj is considered to be an achromatic color. Therefore, the intermediate color c[ij] is added to the representable color list (step S93), and the processing advances to step S94. If the difference dj is not less than the threshold value d3 (no at step S92), the fourth condition is satisfied and the second available thread color cj is considered to be a chromatic color. In this case, the above-described four conditions are all satisfied. Therefore, the intermediate color c[ij] is not added to the representable color list and the processing advances to step S94.

At step S94, if the variable j is less than the total number N of the available thread colors (yes at step S94), one is added to the variable j (step S95), and the processing returns to step S83. Then, the above-described processing from steps S83 to S95 is repeated until the variable j reaches the total number N. If the variable j reaches the total number N, and the combinations of the first available thread color ci and each of the available thread colors have been processed (no at step S94), it is determined whether the variable i is less than the total number N of the available thread colors (step S96). If the variable i is less than the total number N (yes at step S96), one is added to the variable i (step S97), and the processing returns to step S82. Then, the above-described processing from steps S82 to S97 is repeated until the variable i reaches the total number N. If the variable i reaches the total number N and all the available thread colors have been processed as the first available thread color ci (no at step S96), the representable color list generation processing shown in FIG. 12 ends. In this way, according to the representable color list generation processing shown in FIG. 12, it is possible to include in the representable color list only the intermediate colors that are effective to a certain extent when used in the mixed color representation. As a result, it is possible to determine the use thread colors that are even more suitable to represent the colors of the original image.

Further modifications may be made to the above-described embodiments. For example, at step S19 in the thread color determination processing of the third embodiment shown in FIG. 8, in a case where the number N3 of the candidate thread colors are selected in the descending order of usage frequency from among the number N of the available thread colors, processing may be performed such that, from the already selected candidate thread colors, an available thread color within a predetermined distance in the RGB color space is not taken as the candidate thread colors. In this case, the selected candidate thread colors maintain a certain distance between each other, and it is possible to determine the use thread colors that are even more suitable to represent the colors of the whole original image. In addition, the same processing may be performed in the thread color determination processing of the fourth embodiment shown in FIG. 10 and FIG. 11. Specifically, between steps S56 and S57 shown in FIG. 11, a step may be added in which a determination is made as to whether a distance between the first target thread color ciT1 and the second target thread color ciT2 exceeds a predetermined distance. Then, if the distance between the first target thread color ciT1 and the second target thread color ciT2 exceeds the predetermined distance, the processing may advance to step S57 and the total value of the usage frequencies may be updated. If the distance between the first target thread color ciT1 and the second target thread color ciT2 does not exceed the predetermined distance, the processing may simply advance to step S58 without any update.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An embroidery data generation apparatus that generates embroidery data based on image data of an image that is an aggregate of pixels, the embroidery data generation apparatus comprising:

a thread color number setting portion that sets a number of use thread colors as a set number, the use thread colors being thread colors to be actually used in embroidery sewing by a sewing machine;

a representable color identifying portion that identifies available thread colors and at least one intermediate color as representable colors, the available thread colors being thread colors available for use in the embroidery sewing by the sewing machine, and each of the at least one intermediate color being an intermediate color between two colors among the available thread colors;

a first usage frequency calculating portion that calculates first usage frequencies of the representable colors, each of the first usage frequencies being a usage frequency of each of the representable colors in the image that is color-reduced using, as representative colors, the representable colors identified by the representable color identifying portion; and a use thread color determining portion that, based on the first usage frequencies calculated by the first usage frequency calculating portion, determines, as the use thread colors, available thread colors of the set number set by the thread color number setting portion, from among the available thread colors.

2. The embroidery data generation apparatus according to claim 1, wherein the use thread color determining portion includes:

a first determining portion that, from among the available thread colors, determines, as a use thread color, an available thread color corresponding to a representable color that has a first usage frequency that is highest among the first use frequencies calculated by the first usage frequency calculating portion;

a first total value calculating portion that, based on the first usage frequencies of the representable colors, calculates first total values of the available thread colors excepting a determined thread color, the determined thread color being an available thread color already determined as a use thread color, each of the first total values being a total value of a first usage frequency of each of the available thread colors excepting the determined thread color and a first usage frequency of an intermediate color of the determined thread color and the each of the available thread colors excepting the determined thread color; and a second determining portion that, from among the available thread colors excepting the determined thread color, determines, as a use thread color, an available thread color that has a first total value that is highest among the first total values calculated by the first total value calculating portion, and the first total value calculating portion and the second determining portion repeat processing in order until a number of the use thread colors reaches the set number.

3. The embroidery data generation apparatus according to claim 1, wherein the use thread color determining portion includes:

a second total value calculating portion that, based on the first usage frequencies calculated by the first usage frequency calculating portion, calculates second total values for combinations each selecting the set number of the available thread colors from among the available thread colors, each of the second total values being a total value of first usage frequencies of representable colors, among the representable colors, that can be represented by each of the combinations; and a third determining portion that determines, as the use thread colors, the set number of the available thread colors that are included in a combination having a second total value that is highest among the second total values calculated by the second total value calculating portion.

4. The embroidery data generation apparatus according to claim 3, wherein the use thread color determining portion includes:

a representable color selecting portion that selects, from among the representable colors, a predetermined number of representable colors in descending order of the first usage frequencies calculated by the first usage frequency calculating portion; and a first candidate selecting portion that, from among the available thread colors, selects first candidate thread colors, each of the first candidate thread colors being available thread colors necessary to represent, using one of one color and two colors, each of the predetermined number of the representable colors selected by the representable color selecting portion, the second total value calculating portion calculates the second total values for the combinations each selecting the set number of the first candidate thread colors from among the first candidate thread colors selected by the first candidate selecting portion, and the third determining portion determines, as the use thread colors, the set number of the first candidate thread colors that are included in the combination having the second total value that is highest among the second total values calculated by the second total value calculating portion.

5. The embroidery data generation apparatus according to claim 1, wherein the use thread color determining portion includes:

a second usage frequency calculating portion that calculates second usage frequencies based on the first usage frequencies calculated by the first usage frequency calculating portion, each of the second usage frequencies being a usage frequency of each of the available thread colors;

a second candidate selecting portion that, from among the available thread colors, selects a predetermined number of second candidate thread colors, the predetermined number of the second candidate thread colors being a predetermined number of the available thread colors in descending order of the second usage frequencies calculated by the second usage frequency calculating portion;

a third total value calculating portion that, based on the first usage frequencies calculated by the first usage frequency calculating portion, calculates third total values for the combinations each selecting the set number of the second candidate thread colors from among the predetermined number of the second candidate thread colors selected by the second candidate selecting portion, each of the third total values being a total value of the first usage frequencies of representable colors, among the representable colors, that can be represented by each of the combinations; and a fourth determining portion that determines, as the use thread colors, the set number of the second candidate thread colors that are included in a combination having a third total value that is highest among the third total values calculated by the third total value calculating portion.

6. The embroidery data generation apparatus according to claim 1, wherein the representable color identifying portion identifies the representable colors after identifying, as each of the at least one intermediate color, an intermediate color between two colors, among the available thread colors, that are separated from each other by a distance in a color space that is equal to or larger than a threshold value.

7. The embroidery data generation apparatus according to claim 1, wherein in a case where an intermediate color between two chromatic colors among the available thread colors is a gray color, the representable color identifying portion identifies the representable colors after identifying the at least one intermediate color excluding the gray color.

8. A computer program product stored on a non-transitory computer-readable medium, comprising instructions for causing a computer of an embroidery data generation apparatus that generates embroidery data based on image data of an image that is an aggregate of pixels, to execute the steps of:

setting a number of use thread colors as a set number, the use thread colors being thread colors to be actually used in embroidery sewing by a sewing machine;

identifying available thread colors and at least one intermediate color as representable colors, the available thread colors being thread colors available for use in the embroidery sewing by the sewing machine, and each of the at least one intermediate color being an intermediate color between two colors among the available thread colors;

calculating first usage frequencies of the representable colors, each of the first usage frequencies being a usage frequency of each of the representable colors in the image that is color-reduced using, as representative colors, the representable colors that have been identified; and determining, based on the first usage frequencies that have been calculated, as the use thread colors, available thread colors of the set number that has been set, from among the available thread colors.

9. The computer program product according to claim 8, wherein the step of determining the use thread colors includes the steps of:

determining, from among the available thread colors, as a use thread color, an available thread color corresponding to a representable color that has a first usage frequency that is highest among the first use frequencies that have been calculated;

calculating, based on the first usage frequencies of the representable colors, first total values of the available thread colors excepting a determined thread color, the determined thread color being an available thread color already determined as a use thread color, each of the first total values being a total value of a first usage frequency of each of the available thread colors excepting the determined thread color and a first usage frequency of an intermediate color of the determined thread color and the each of the available thread colors excepting the determined thread color; and determining, from among the available thread colors excepting the determined thread color, as a use thread color, an available thread color that has a first total value that is highest among the first total values that have been calculated, and the step of calculating the first total values and the step of determining as the use thread color the available thread color that has the first total value that is highest are repeated in order until a number of the use thread colors reaches the set number.

10. The computer program product according to claim 8, wherein the step of determining the use thread colors includes the steps of:

calculating, based on the first usage frequencies that have been calculated, second total values for combinations each selecting the set number of the available thread colors from among the available thread colors, each of the second total values being a total value of first usage frequencies of representable colors, among the representable colors, that can be represented by each of the combinations; and determining, as the use thread colors, the set number of the available thread colors that are included in a combination having a second total value that is highest among the second total values that have been calculated.

11. The computer program product according to claim 10, wherein the step of determining the use thread colors includes the steps of:

selecting, from among the representable colors, a predetermined number of representable colors in descending order of the first usage frequencies that have been calculated; and selecting, from among the available thread colors, first candidate thread colors, each of the first candidate thread colors being available thread colors necessary to represent, using one of one color and two colors, each of the predetermined number of the representable colors that have been selected, the second total values are calculated for the combinations each selecting the set number of the first candidate thread colors from among the first candidate thread colors that have been selected, and the set number of the first candidate thread colors that are included in the combination having the second total value that is highest among the second total values that have been calculated are determined as the use thread colors.

12. The computer program product according to claim 8, wherein the step of determining the use thread colors includes the steps of:

calculating second usage frequencies based on the first usage frequencies that have been calculated, each of the second usage frequencies being a usage frequency of each of the available thread colors;

selecting, from among the available thread colors, a predetermined number of second candidate thread colors, the predetermined number of the second candidate thread colors being a predetermined number of the available thread colors in descending order of the second usage frequencies that have been calculated;

calculating, based on the first usage frequencies that have been calculated, third total values for the combinations each selecting the set number of the second candidate thread colors from among the predetermined number of the second candidate thread colors that have been selected, each of the third total values being a total value of the first usage frequencies of representable colors, among the representable colors, that can be represented by each of the combinations; and determining, as the use thread colors, the set number of the second candidate thread colors that are included in a combination having a third total value that is highest among the third total values that have been calculated.

13. The computer program product according to claim 8, wherein the representable colors are identified after an intermediate color between two colors, among the available thread colors, that are separated from each other by a distance in a color space that is equal to or larger than a threshold value are identified as each of the at least one intermediate color.

14. The computer program product according to claim 8, wherein in a case where an intermediate color between two chromatic colors among the available thread colors is a gray color, the representable colors are identified after the at least one intermediate color excluding the gray color is identified.

* * * * *